US005558624A

United States Patent [19]

Hepburn et al.

[11] Patent Number: 5,558,624

[45] Date of Patent: Sep. 24, 1996

[54] SHOULDER PHYSICAL THERAPY DEVICE

[75] Inventors: George R. Hepburn, Severna Park; Russell Vedeloff, Greensboro, both of Md.

[73] Assignee: Dynasplint Systems, Inc., Severna Park, Md.

[21] Appl. No.: 493,403

[22] Filed: Jun. 22, 1995

[51] Int. Cl.[6] ..... A61F 5/04

[52] U.S. Cl. ..... 601/33; 482/130; 482/136

[58] Field of Search ..... 601/5, 24, 33, 601/34, 89, 97; 482/121, 127, 128, 129, 130, 133, 139, 135, 907, 136; 5/646, 647

[56] References Cited

U.S. PATENT DOCUMENTS

| | | | |
|---|---|---|---|
| 3,029,076 | 1/1961 | Anderson | 482/128 |
| 3,683,897 | 8/1972 | Shield et al. | 601/34 |
| 4,214,577 | 7/1980 | Hoy | 601/33 |
| 4,577,623 | 3/1986 | Pecheux | 601/34 |
| 4,651,719 | 3/1987 | Funk et al. | 128/25 R |
| 4,669,451 | 6/1987 | Blauth et al. | 128/25 R |
| 5,179,939 | 1/1993 | Donovan et al. | 128/25 R |
| 5,335,649 | 8/1994 | Randall et al. | 601/24 |
| 5,417,643 | 5/1995 | Taylor | 601/33 |
| 5,486,150 | 3/1996 | Randolph | 482/133 |

FOREIGN PATENT DOCUMENTS

| | | | |
|---|---|---|---|
| 308886 | 11/1918 | Germany | 601/33 |

*Primary Examiner*—Richard J. Apley
*Assistant Examiner*—David R. Risley
*Attorney, Agent, or Firm*—Leonard Bloom

[57] ABSTRACT

The herein disclosed invention is directed to an articulated physical therapy device used in the therapy of a frozen shoulder. The device can be provided with tensioning means which facilitate exercise.

21 Claims, 17 Drawing Sheets

SHOULDER PHYSICAL THERAPY DEVICE

FIELD OF THE INVENTION

This relates to physical therapy devices, and more specifically, to adjustable devices intended to treat shoulder joint contracture or "frozen shoulder".

BACKGROUND OF THE INVENTION

Many physiological conditions can bring on a condition known in laymen's as "frozen-shoulder", known technically in medical terms as Adhesive Capsulitis. This condition causes a restricted range of motion of the shoulder due to the contracture of tendons, muscles, ligaments and the capsule surrounding the joint. The condition can be brought about by a fall, the tearing of the rotator cuff, surgical repair of the rotator cuff, fracture of the Humerus or bursitis, etc. The condition is brought about because the tendons and muscles surrounding the joint capsule and rotator cuff shrink down and tighten up. This condition is most prevalent in the 35–75 year age bracket.

The shoulder is formed where the clavicle, scapula and humerus join. The joint formed is a ball-and-socket type articulation between the proximal humerus and the glenoid cavity of the scapula. The socket is shallow, and the joint capsule is loose-fitting. As a result of this construction, the joint permits a wide range of motion but is subject to poor stability and strength.

The shoulder is capable of three general types of motion: abduction and adduction, flexion and extension; and rotation. Aduction and adduction are movements of the arm away from and toward the median axis, or long axis, in the median plane of the body. The median plane of the body is defined by the front or back of the body in a straight position. Aduction is movement away from the median axis, such as raising an arm laterally or sideways. Adduction is the opposite movement, i.e., movement toward the median plane of the body. Rotation is turning the arm about its long axis as if on a pivot. External rotation is rotation away from the median axis of the body and internal rotation is rotation toward the median axis of the body.

PRIOR ART U.S. PATENTS

In U.S. Pat. No. 4,669,451, Bleuth et al teach a device for exercising the shoulder joint. The device is secured to the body and is able to exercise the shoulder in a horizontal pivot axis, as well as a vertical pivot axis; which two axes intersect each other in the afflicted shoulder joint. An additional motion generating and transmitting unit can be provided to pivot two articulated connected portions of the arm support in the region of the elbow.

Funk et al in U.S. Pat. No. 4,651,719 describes a lightweight portable device to impart continuous passive motion to a user's shoulder. The device is fashioned to produce abduction, adduction, as well as simultaneous rotation. The device produces continuous passive motion to the shoulder. The device passively produces abduction and adduction of the arm about the shoulder and optionally causes simultaneous rotation of the arm as well. The device is actuated by a mechanical drive mechanism.

A passive shoulder exerciser to move the patient's arm back and forth through an arc to provide flexion and abduction of the shoulder is described by Donovan et al in U.S. Pat. No. 5,179,939. The device is a motor driven passive device.

Randall et al in U.S. Pat. No. 5,335,649 describes a mechanized machine employed in various stretching exercises. Different parts of the body can be exercised.

None of the prior art patents teach or suggest an articulated frozen-shoulder physical therapy device which is multi-axial, with a choice of preset tensioning points.

OBJECTS OF THE INVENTION

With all of this in mind, it is an object of this invention to produce a physical therapy device facilitating the treatment and cure of frozen-shoulder or shoulder contracture.

A most important object of this invention is to produce a device which will shorten the recovery time for the patient with shoulder contracture.

A further object of this invention is to produce a device which is easy for the physical therapist, as well as the patient to use.

SUMMARY OF THE INVENTION

The DynaSplint physical therapy device or the Shoulder LPS™ (Low-Load, Prolonged-Duration Stress) System of this invention is a device designed primarily to treat "Frozen Shoulder". This condition is not necessarily painful, but does involve the inability to elevate the arm. The condition in the past has been treated with physical therapy; or by surgery under general anesthesia, with the shoulder being forcefully manipulated and the frozen state relieved.

The DynaSplint frozen shoulder physical therapy device is designed to eliminate surgery and improve patient recovery time, thereby assuring quick return to a normal routine. Success of the treatment will be known when the patient is able to achieve a position of 135 degrees of abduction, 90 degrees of external rotation and 180 of flexion. Improved recovery time will bring about reduced medical expenses and will thereby be cost-saving to the patient and/or the patient's insurer.

The method of therapy for the release of frozen shoulder envisioned by this invention is the stretching and stressing of the joint using the frozen shoulder physical therapy device, supplemented with an ongoing physical therapy program. The device will be used only about a half hour per session, with the object of the therapy being to get release of the contracture.

The Dynasplint frozen shoulder physical therapy device is a departure from prior Dynasplint braces known in the art. The prior braces were made of a single hinged joint. They were made to accommodate the wrist, elbow, knee or ankle, etc. which are primarily simple hinged joints. On the other hand the shoulder moves in all planes and therefore the new device has to have more adjustments. The adjustments relate to ranges; and being able to adjust and accommodate the patient for flexion, extension, as well as internal and external rotation; abduction and adduction. The device of this invention combines several motions and is a multiaxial rotational device. Flexion and abduction are combined into elevation. Elevation and external rotation are set with the protractor device at a specific angle. Once the protractor is set, the shoulder when put in motion will find the path of least resistance. After resting at that point, the device allows the shoulder to glide back at just the right point.

The inventive frozen shoulder therapy device, unlike passive shoulder therapy devices of the prior art, depends on motion from the patient. In other words the patient moves the device; the device does not move the patient since the inventive device is not motor-driven. The Dynasplint physical therapy device is spring loaded and in use will tend to force the patient back, and put the shoulder under pressure, but when relief from stress is desired the patient can release the tension and reduce discomfort simply by reverting to the unstressed state. This is a significant feature of the inventive device.

The new physical therapy unit is similar to the existing line of DynaSplint therapy devices in that there are multiple adjustments in the amount of stress or tension in the unit. There are two movements in which stress or tension are applied. These are elevation and external rotation. There is one spring which exerts pressure when the arm is elevated, there is a second spring which exerts pressure when the arm is externally rotated, and the tensions can be adjusted on each.

The articulated frozen shoulder physical therapy device of the invention can be characterized as having an 1. adjustable forearm strut,
2. a reciprocating, telescoping upper arm strut,
3. a retaining means,
4. an adjustable protractor, and
5. a base.

The adjustable forearm strut is hingedly attached to the telescoping upper arm strut which in turn is hingedly attached to a protractor retaining means secured to the base.

The articulated portions of the device accommodate the way the shoulder moves; they compliment arm movement. In order to further accommodate arm movement the therapy device employs a reciprocating telescoping upper arm strut. This telescoping strut is finely engineered with bearings and rods and telescopes freely. This reciprocating telescopic arrangement is a key factor for obtaining functionality for the frozen shoulder physical therapy device.

The new device accommodates multiaxial rotation of the shoulder. The term multiaxial rotation means that the frozen-shoulder therapy device allows for the multiaxial movement of the shoulder joint while maintaining the position of the device attached to the patient. For example, the multiaxial movement will accommodate vertical abduction and vertical adduction; horizontal abduction and horizontal adduction; as well as, external rotation and internal rotation.

In its broadest aspect this invention is directed to an articulated frozen shoulder physical therapy device for extending the range of motion of a frozen shoulder. The device is an articulated device which allows for the active multiaxial exercise of a frozen shoulder. The articulated device is provided with a forearm strut and an upper arm strut, as well as one or more tensioning means to place stress on the shoulder during active multiaxial exercise. As a result of the exercise, mobility of the shoulder is hastened. The shoulder returns to normal mobility in the directions of flexion, extension, abduction, adduction, horizontal abduction, horizontal adduction, external rotation and internal rotation. The new articulated frozen shoulder physical therapy device has a tensioning means to place stress on the shoulder positioned at the elbow hinge and/or shoulder hinge.

The articulated frozen shoulder physical therapy device can have a tensioning means provided with a mechanism for quantifiably adjusting the amount of tension.

In addition, the shoulder physical therapy device has an upper arm strut which is a reciprocating telescoping strut allowing for lengthening or shortening of the telescoping strut during active multiaxial exercise of a frozen shoulder.

Further, the device has a forearm strut provided with a means to adjust the length, as well as a means to secure the arm to the strut.

There is a base having mounted thereon a protractor and fixedly attached to the protractor a securing means for attaching said articulated frozen shoulder physical therapy device.

The invention is more specifically directed to an articulated frozen shoulder physical therapy device releasing a frozen shoulder. The device allows for multiaxial exercise of the frozen shoulder in the directions of flexion, extension, abduction, adduction, horizontal abduction, horizontal addiction, external rotation and internal rotation. The main components of the device area:

an adjustable forearm strut, a reciprocating, telescoping upper arm strut, an adjustable protractor retaining means, and a base.

The forearm strut has attached thereto a means for retaining the forearm. The telescoping upper arm strut is tensionally hinged to said adjustable forearm strut. The telescoping upper arm strut is pivotally tensionally attached to an adjustable protractor retaining means which in turn is attached to said adjustable protractor attached to the base. When a patient is fitted into the device with the tensioning means set, the patient can engage in multiaxial physical therapy for a frozen shoulder. The articulated frozen shoulder physical therapy device is provided with an adjustable spring which produces the tension on the tensionally hinged and pivotally tensionally attached components of the device. The spring is provided with a mechanism for quantifiably adjusting the amount of tension. The forearm strut is provided with a means to adjust the length of the forearm strut and has a means for securing the arm to the forearm strut.

GENERAL DESCRIPTION OF THE PREFERRED EMBODIMENT

Figure 1:
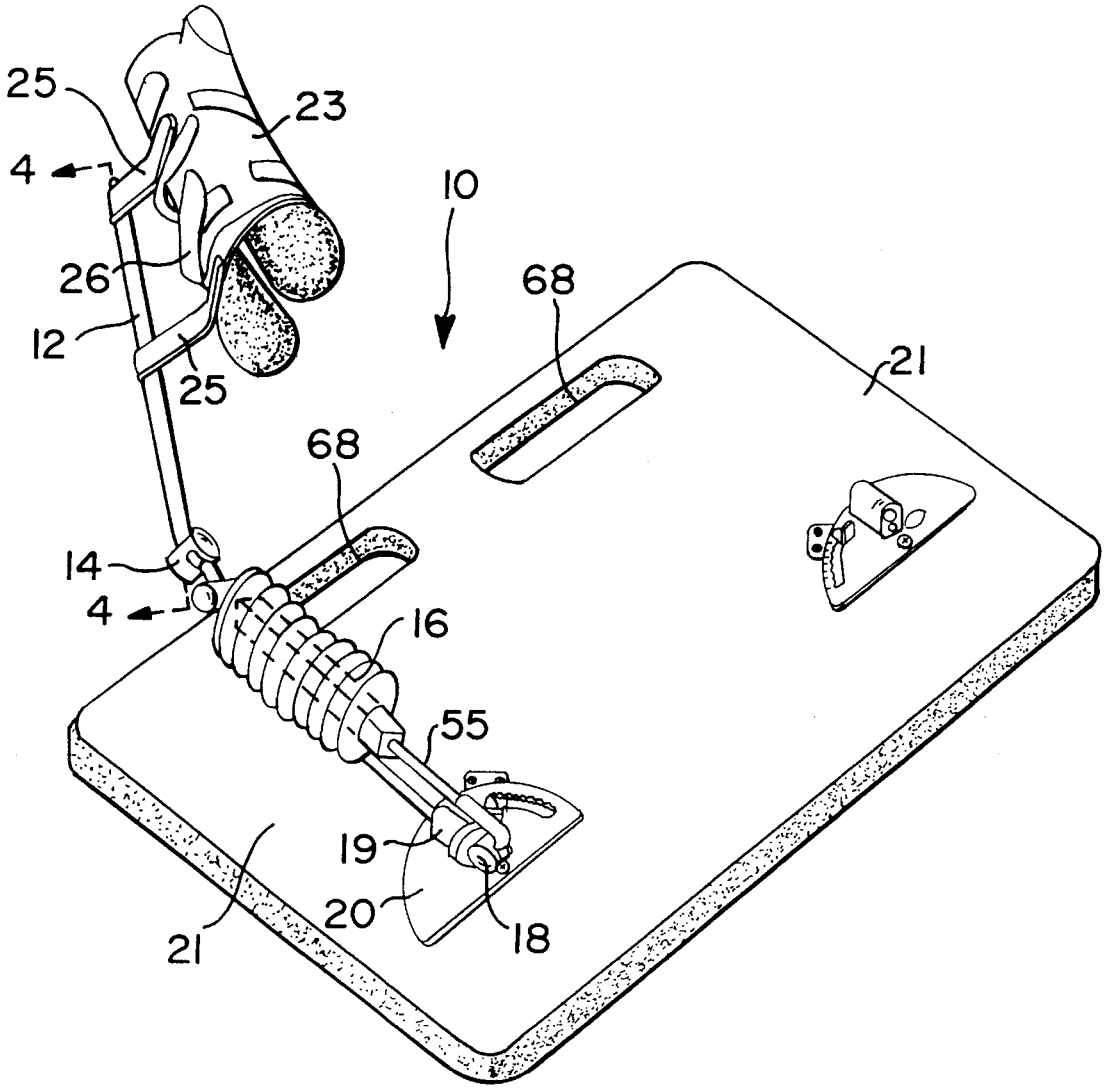
FIG. 1 is a perspective view of the frozen-shoulder physical therapy device of this invention.

Referring to FIG. 1, the articulated frozen-shoulder physical therapy device 10 of this invention is shown in the extended position. The device 10 is provided with an articulated forearm strut 12 hingedly attached as at 14, to a reciprocating telescoping upper arm strut 16. The opposite end of the telescoping upper arm strut 16 is pivotally hinged,as at 18, to a retainer or retaining means 19 mounted on a protractor gauge 20. The protractor gauge 20 in turn is fixedly attached to the back support base 21 of the frozen shoulder physical therapy device 10.

Figure 2:
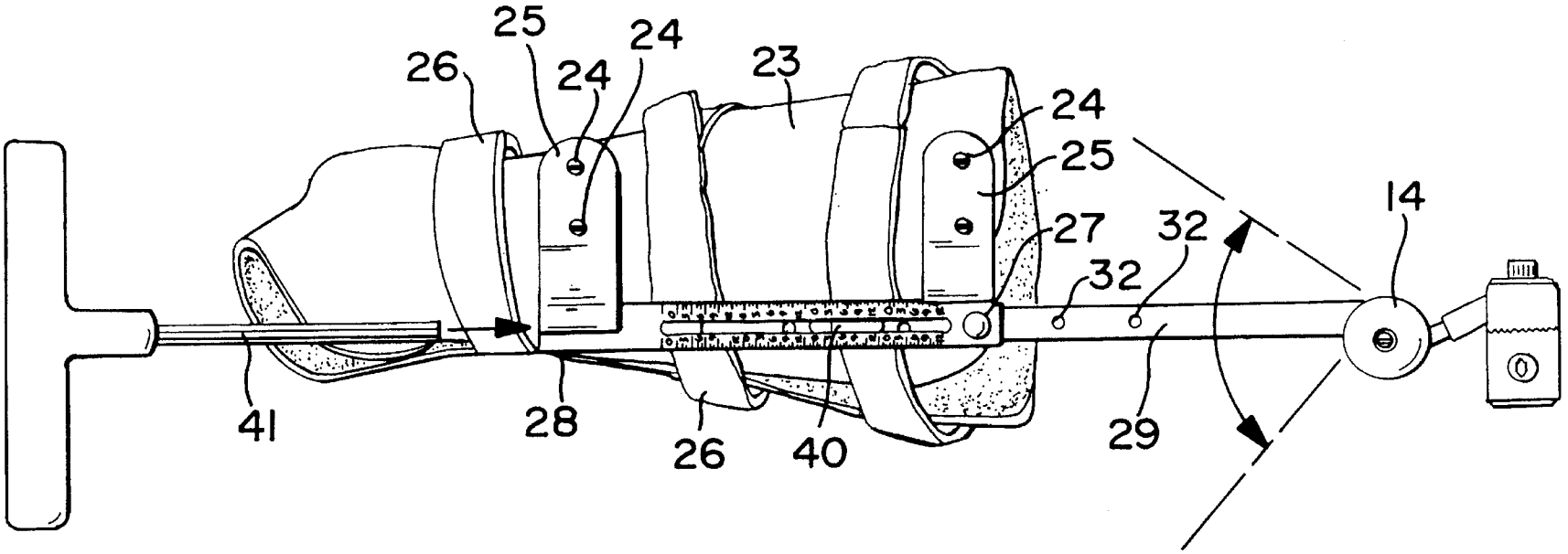
FIG. 2 is a view illustrating the forearm strut assembly.
Figure 3:
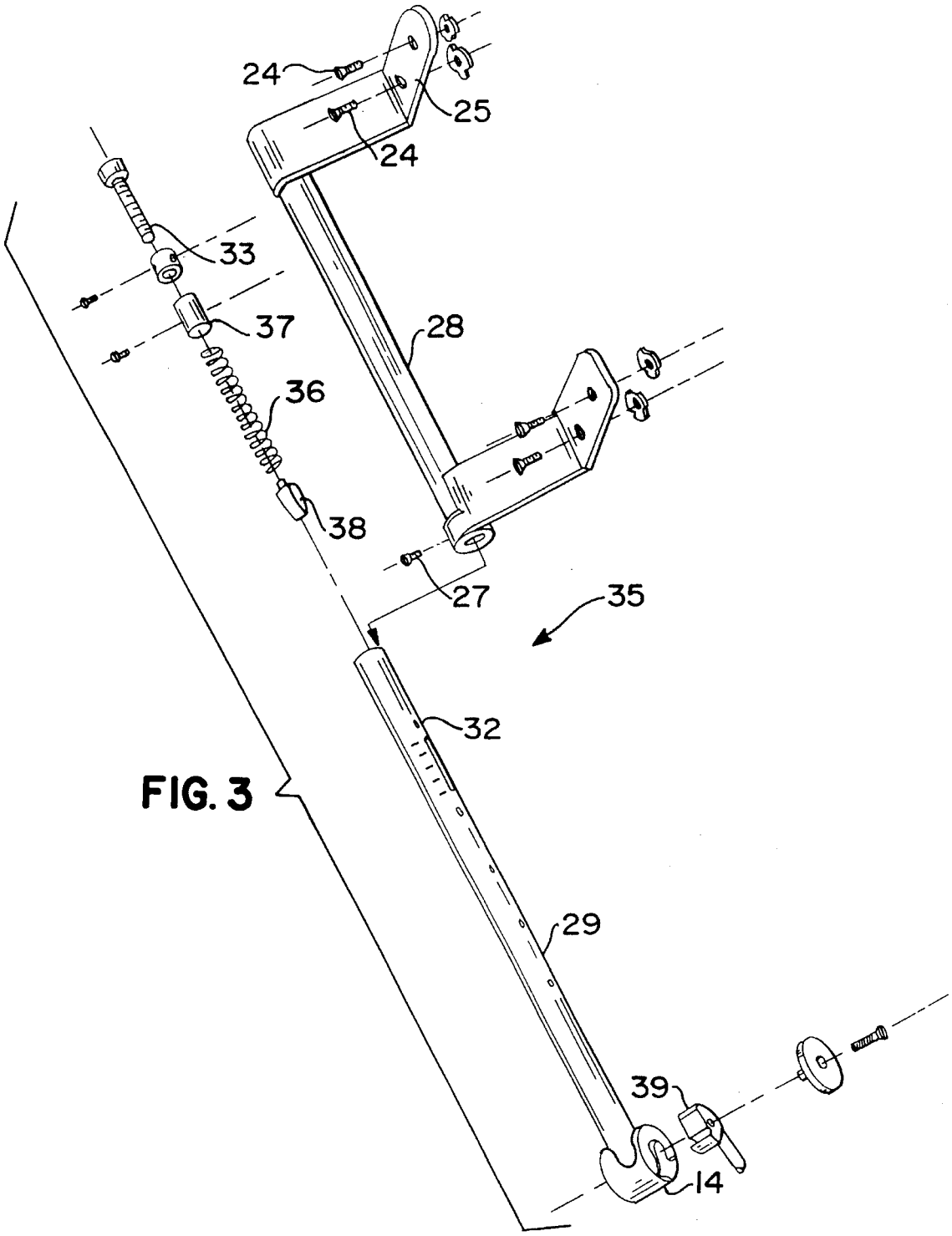
FIG. 3 is an exploded perspective view illustrating the parts of the forearm strut assembly.

With reference to FIGS. 2 and 3, an arm cuff 23 is fixedly attached by screws 24 to brackets 25 carried by the forearm strut 12. In the use of the frozen shoulder physical therapy device 10 the patient inserts his forearm into the cuff 23 and tightens the cuff 23 around the fore arm with "Velcro" strips 26. Forearm strut 12 has an outer portion 28 and an inner portion 29. The outer portion 28 slides over the inner portion 29, and the length of the forearm strut 12 can be adjusted to accommodate the length of the patient's forearm. Holes 31, 32 aligned in the outer portion 28 of the forearm strut 12 and the inner portion 29 of the forearm strut 12 respectively, receive a screw 27 which fixes the length of the forearm strut 12 (as shown more clearly in FIG. 2 and 3).

As previously pointed out, the forearm strut 12 is attached through a hinge 14 to the telescoping upper arm strut 16. This hinge 14 is unique in that it has within it an adaptable spring tensioning device 35 shown in detail in FIGS. 3–6.

Figure 4:
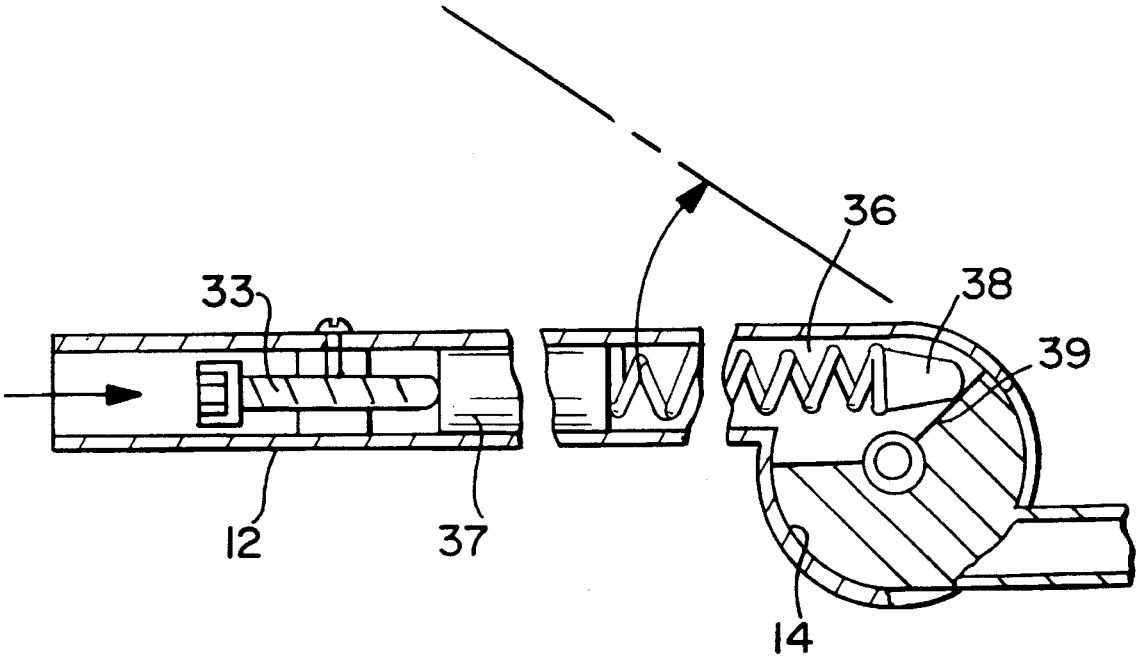
FIG. 4 is a longitudinal sectional view illustrating the elbow spring-loaded tension mechanism taken along 4—4 of FIG. 1.
Figure 5:
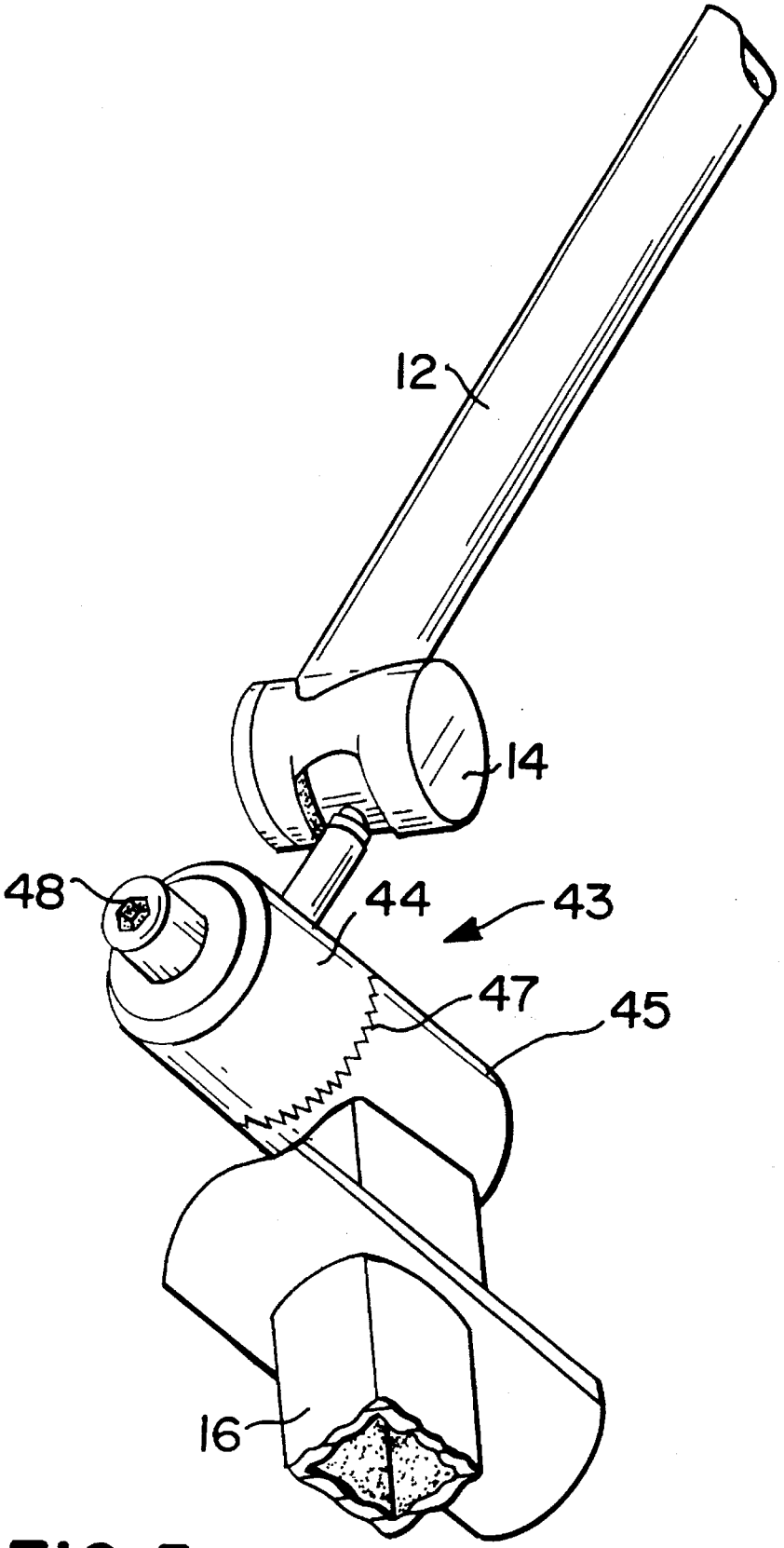
FIG. 5 is an enlarged perspective view illustrating the assembly of components of the elbow pivot or hinge and serrated positioning means.
Figure 6:
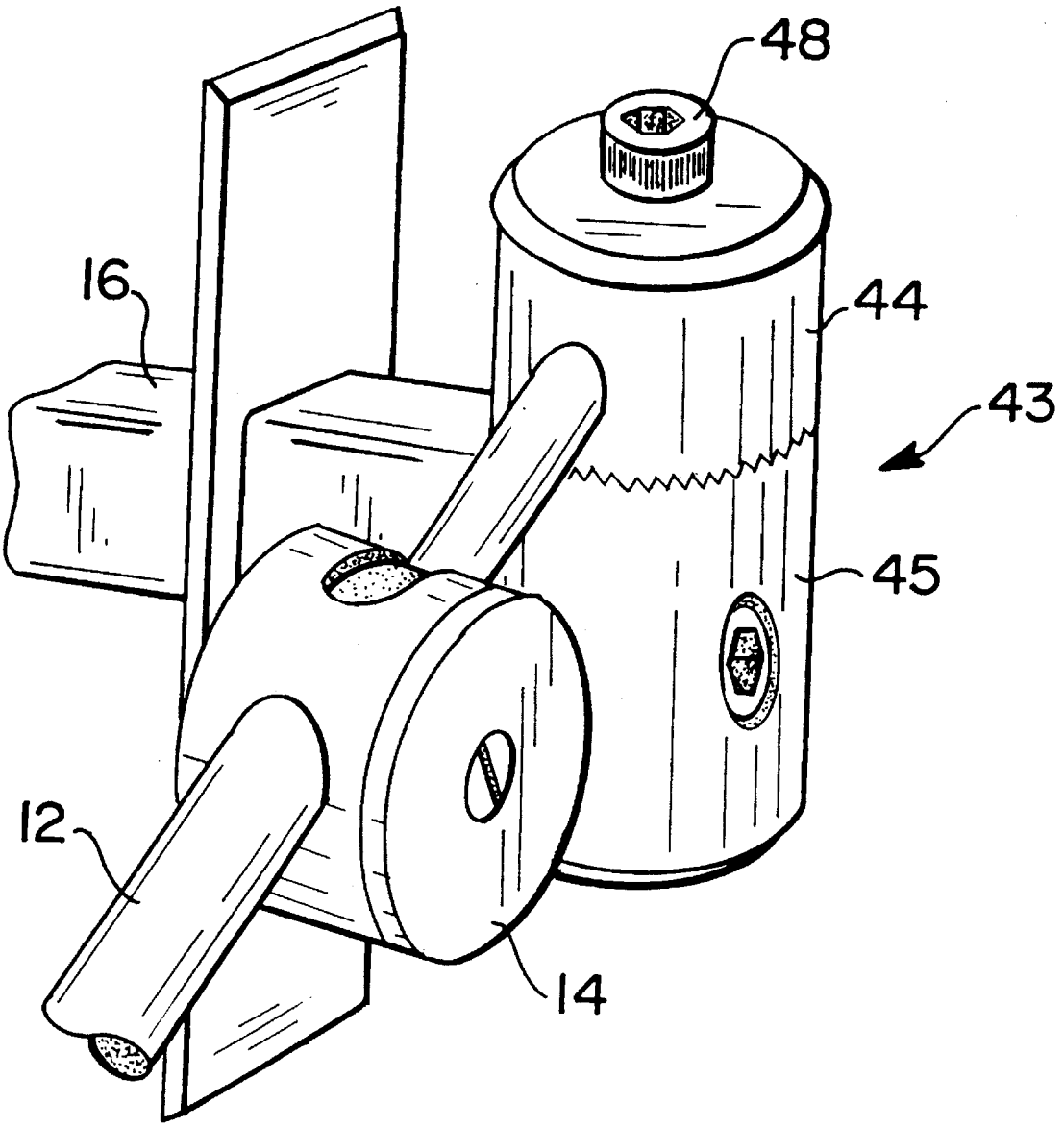
FIG. 6 is another perspective view of the elbow pivot and serrated positioning means taken from the opposite direction.

Referring particularly to FIGS. 3 and 4, the adjustable-spring tensioning device 35 (employed in the physical therapy device 10 of this invention) is not per se novel, but has been described in U.S. Pat. Nos. 4,508,111 and 4,947,835. However, the tensioning devices of the noted patents were supplied to provide either flexion or extension, and these prior devices are directed to elbows, knees and/or ankles not to shoulder therapy.

The tensioning device 35 (FIGS. 3 and 4) is an adjustable spring mechanism comprised of a spring 36 attached to a nose element 38 which bears on a cam surface 39. An adjustable screw 33 abuts a plunger 37 at the other end of the spring 36. The screw 33, when properly turned, produces a quantifiable force which tends to either extend or contract the spring 36. As maximum deflection or flexion is approached, compression is created in the compression-coiled spring 36. The adjustable screw 33 means, per se, is comprised of an "Allen" head screw or slotted head screw threaded to a spring-abutting member 37. The "Allen" head screw is fixed within strut 12 by a screw thread. The "Allen" head screw receives and is turned by an "Allen" socket wrench 41, whereas a slotted head screw is adjustable with a conventional screwdriver blade. The turning of the screw 33 creates greater compression of the spring 36, thereby exerting greater force on the cam surface 39 of the strut 12 to exert a one way tension. The tension capability of the spring mechanism can range from 0 pounds tension up to the maximum tension capable of the spring. In general, the tension of the spring mechanism will range from 0 pounds tension up to 10 pounds of tension and the tension exerted by the spring can be varied at any point of joint range of motion, say from 60° flexion to 0° flexion of the joint.

In the articulated device 10, there are at both the elbow hinge 14 and the shoulder pivot hinge 18, an adjustable spring-loaded tension mechanism designed to place varying amounts of stress or tension at the elbow and shoulder during physical therapy. In use, a quantifiable spring force on the cam causes pressure to be placed on the shoulder through the elbow pivot and the shoulder pivot. Depending on the directional arrangement of the cam, pressure is exercised during flexion or extension.

The amount of tension exerted by the spring 36 can be read on the visible scale 40 in the forearm strut 12 as well as at 58 in shoulder hinge assembly 57. The gauge for both the elbow and shoulder quantifiable spring mechanism is graduated in increments of 3; from 3 to 12: 3 on the gauge represents 1.05 ft. lbs. of pressure; 6 represents 2.28 ft. lbs. of pressure; 9 represents 3.43 ft. lbs. of pressure and 12 represents 4.78 ft. lbs of pressure. In use the pressure applied is the minimum amount to provide tension and then is increased as the patient is able to accomodate more tension.

A unique feature of this device in the present application is the ability of this device to allow graduated, quantified, adjustable tension with the ability to relax the stretch away from the limit of flexion or extension. This will allow the tissue being stretched to have a rest period while not disturbing the adjustment of the spring tension and without having to remove the device. In order to relieve the pressure on the contractured tissues, one merely has to overcome, by any means, the tension in the splint and extend the joint to a comfortable posture. Once a short rest is achieved, the splint may again exert its tension against the contractured tissue to help accomplish a greater degree of flexion in the joint.

Between the forearm strut 12 and the reciprocating telescopic upper arm strut 16 is a strut angle adjusting means 43 (FIGS. 5 and 6) designed to accommodate the angle of the arm at the elbow. The strut angle adjusting means 43 has a top section 44 and a bottom section 45 joined by serrated teeth 47 in registry. To separate the top section 44 from the bottom section 45, the securing means 48 at the top section 44 is released thus separating the parts to adjust the angle. Once the angle is adjusted, the top 44 and bottom 45 sections can be rejoined using the securing means 48.

Figure 7:
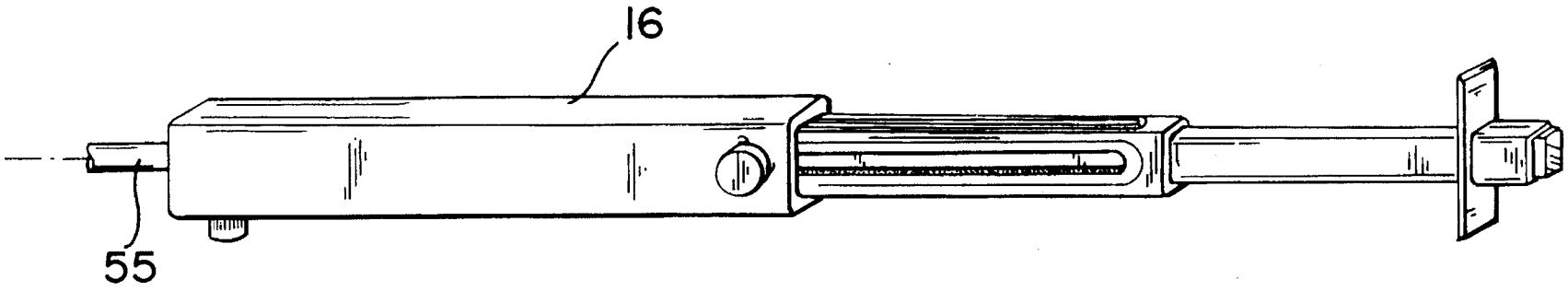
FIG. 7 and 8 are views illustrating the extended telescoping arm provided with the expanding accordion-pleated cover, shown in FIG. 8 in dashed lines.
Figure 8:
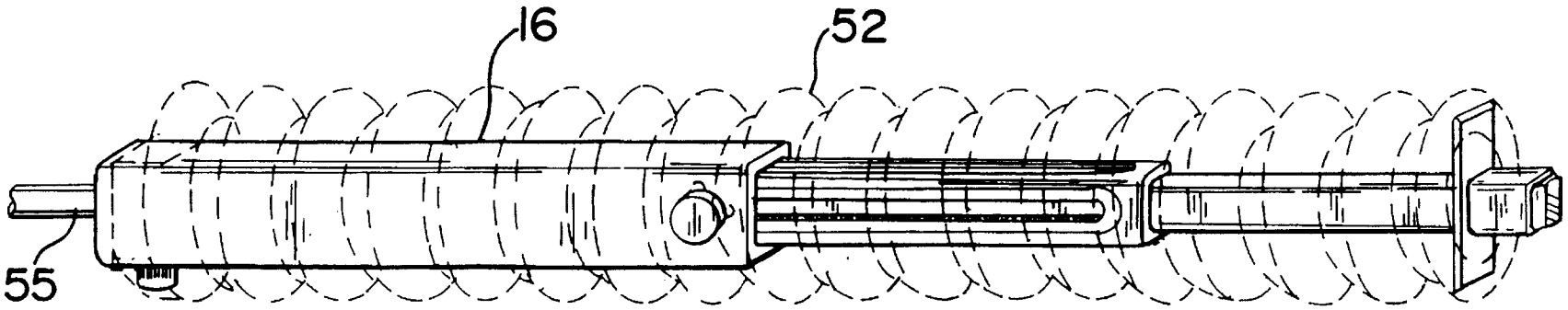
Figure 9:
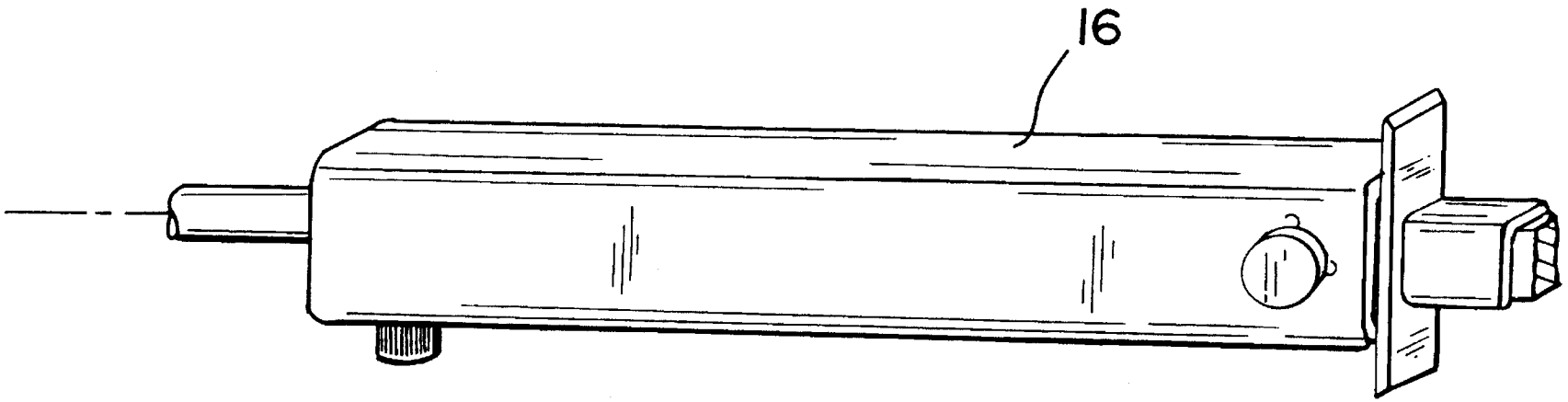
FIG. 9 is a view of the telescoping arm in the retracted position.
Figure 10:
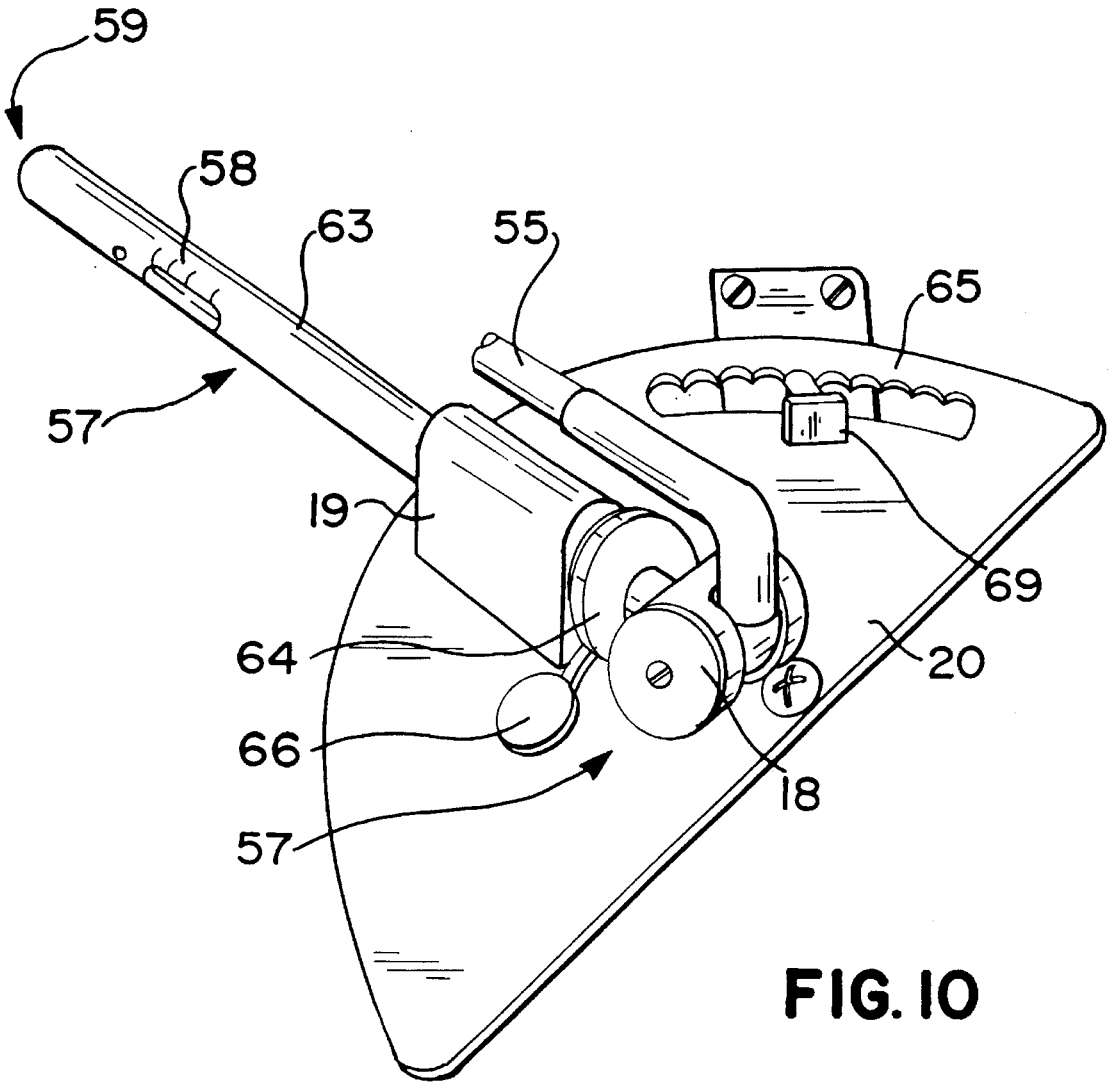
FIG. 10–12 are views of the shoulder pivot assembly with the shoulder spring loaded tension device.
Figure 11:
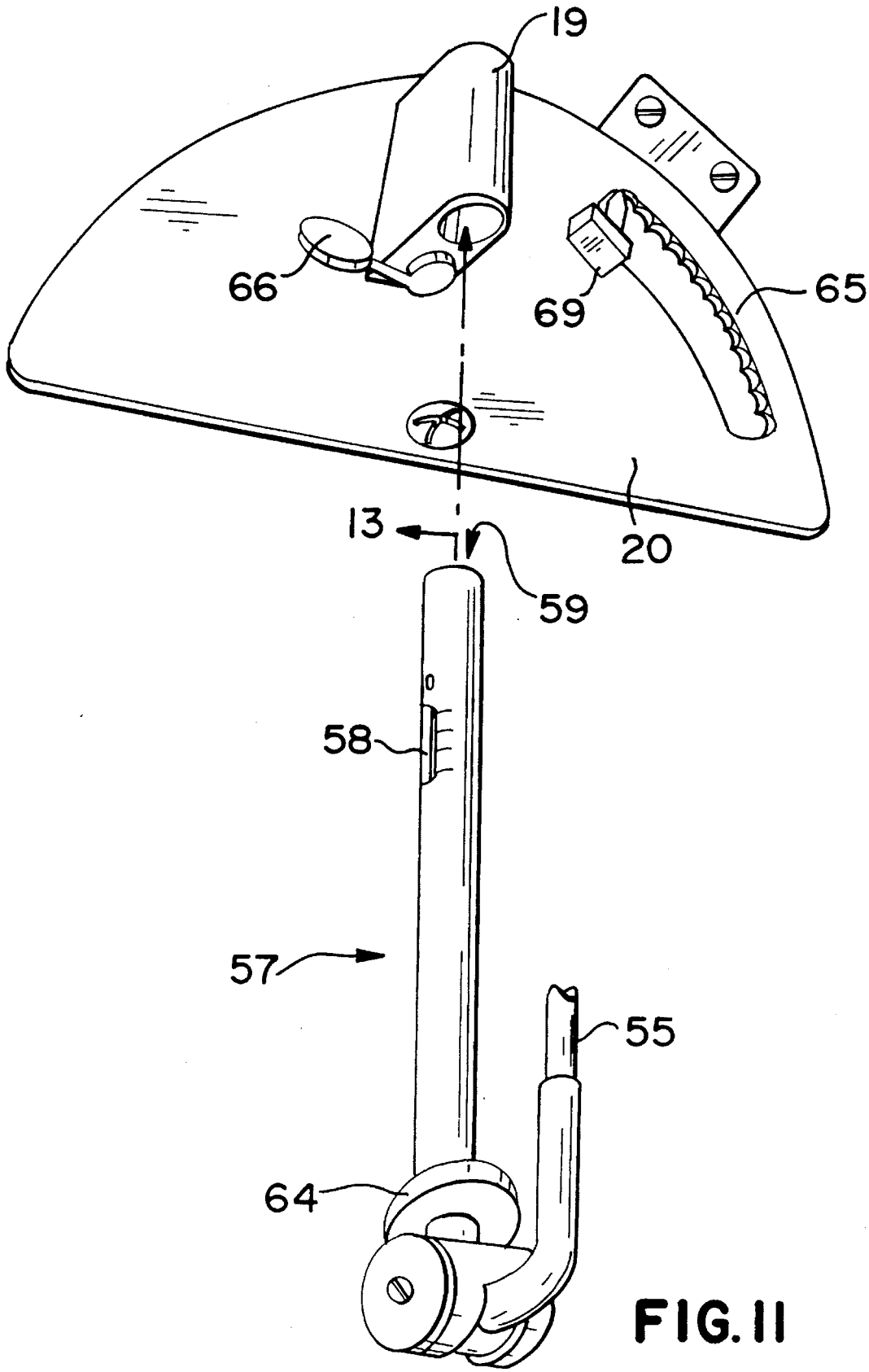
Figure 12:
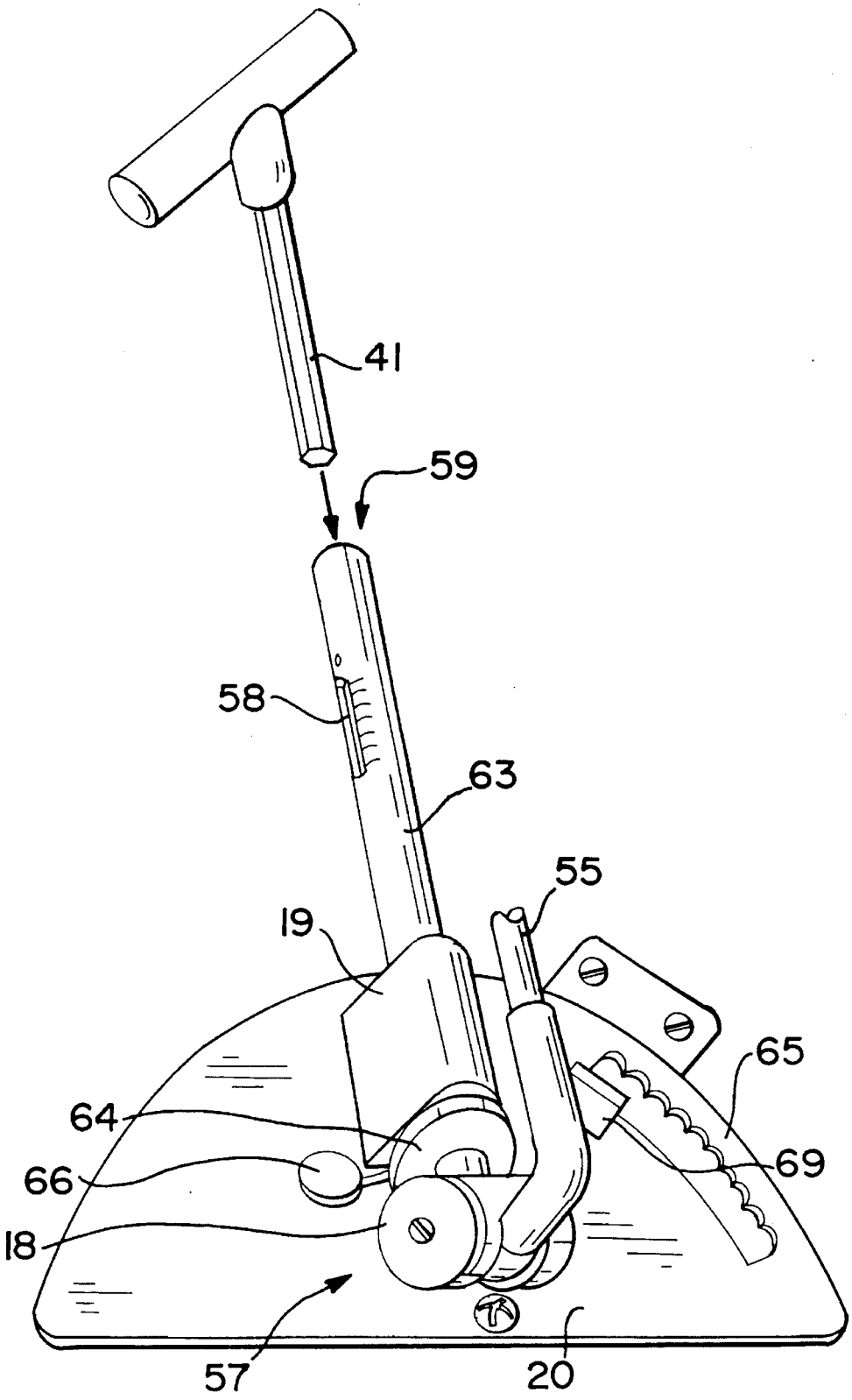

An elegant feature of the physical therapy device 10, is a reciprocating telescoping upper arm strut 16 (FIGS. 7–9). This reciprocating telescoping feature allows for flexion and extension at the shoulder. In FIG. 7, the telescoping strut 16 is in the extended position and in FIG. 9 the strut 16 is in the retracted position. There is an accordion pleated cylinder 52 covering the strut 16 as a protective means shown in broken lines in FIG. 8. As an alternative method for constructing the reciprocating telescoping upper arm strut, linear ball-bushings, scope plates with telescopic rod shafts can be used.

With reference to FIGS. 10–13, a joining member 55 joins the upper arm telescoping strut 16 to the spring tensioned pivotal shoulder hinge assembly 57. The assembly is retained in a retainer 19 affixed to the adjustable protractor 20 on the base 61 of the physical device 10. The spring tension housing 63 serves as the member inserted into the retainer 19 to position the articulated shoulder physical therapy device 10 on the base 61. The spring tension housing 63 inserted into the retainer 19 is fixedly secured in the retainer 19 by locking means 64 which locks around spring tension housing 63 to secure the physical therapy device in the retainer 19. The locking means 64 is held in place by detent 66. The locking means 64 is held securely around the spring tension housing 63. Once the device 10 is in the retainer 19 the device can be tilted 25° on either side of the vertical axis. This tilt is a further aid in providing the device with multiaxial direction. More specifically the tilt of the device, 25° on either side of the vertical axis along with flexing hinge 18 (FIGS. 1, 10 and 12) allows the patient using the device to move the arm in the direction of abduction. As previous defined, "abduction" is defined as the movement away from the median axis of the body, such as raising an arm laterally or sideways.

Figure 13:
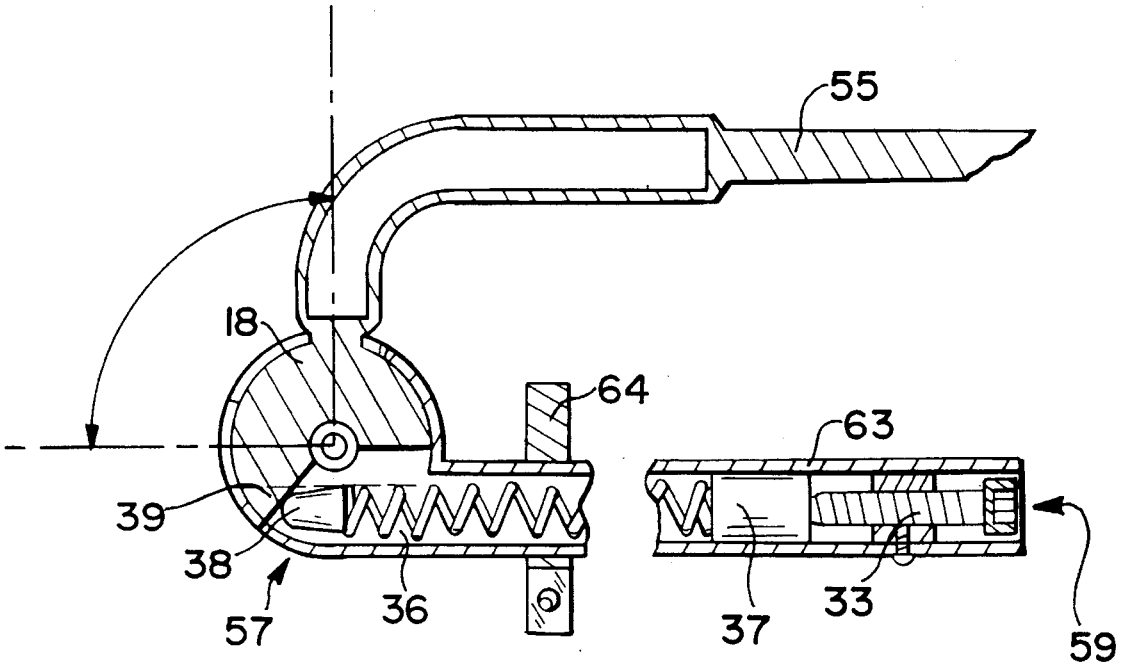
FIG. 13 is a sectional view of the cam mechanism of the spring loaded tension device taken along 13—13 of FIG. 11.
Figure 14:
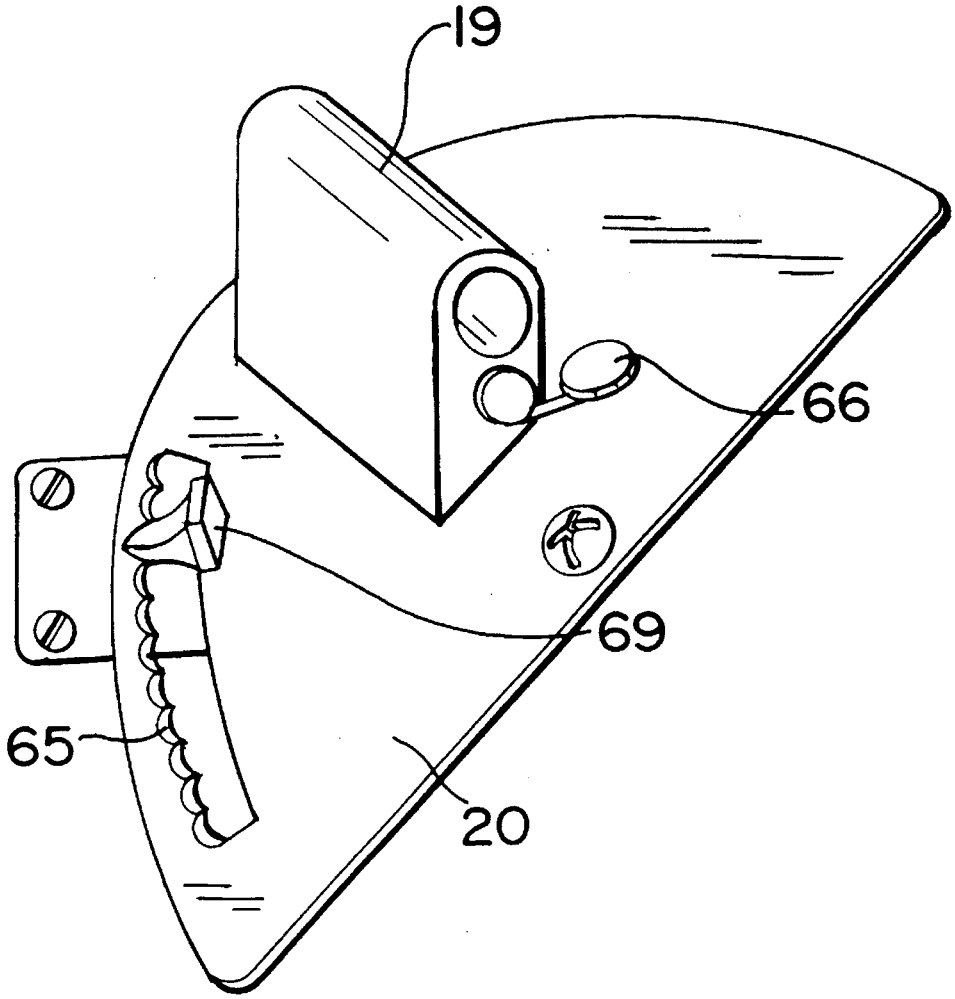
FIG. 14 of the calibrated protractor rotation device and retainer.

The spring tensioned shoulder hinge (FIGS. 10–13) has a quantifiable spring tensioning means shown in cross-section in FIG. 13 and is not unlike that shown for the elbow in that there is a spring 36, a nose element 38, a plunger 37 and a tensioning screw 33 to force the nose element 38 to exert pressure on the cam surface 39. The pressure at the shoulder is exerted on elevation of the upper arm. The quantifiable spring tension means is accessed at 59 in the spring tension housing 63 with Allen wrench 41.

The protractor 20, to which is joined the pivotal hinge 18 is calibrated with calibration gauge 65 to gauge the abduction of the arm from the vertical axis of the body. In use the protractor 20 will be set at a value which is comfortable for the patient taking into account that the shoulder is frozen and lacks mobility. To move the protractor 20 in order to change the angle, the protractor lock 69 is released and the protractor 20 turned by grasping the retainer means 19. The protractor can move through a range of 0° to 70°.

Figure 15:
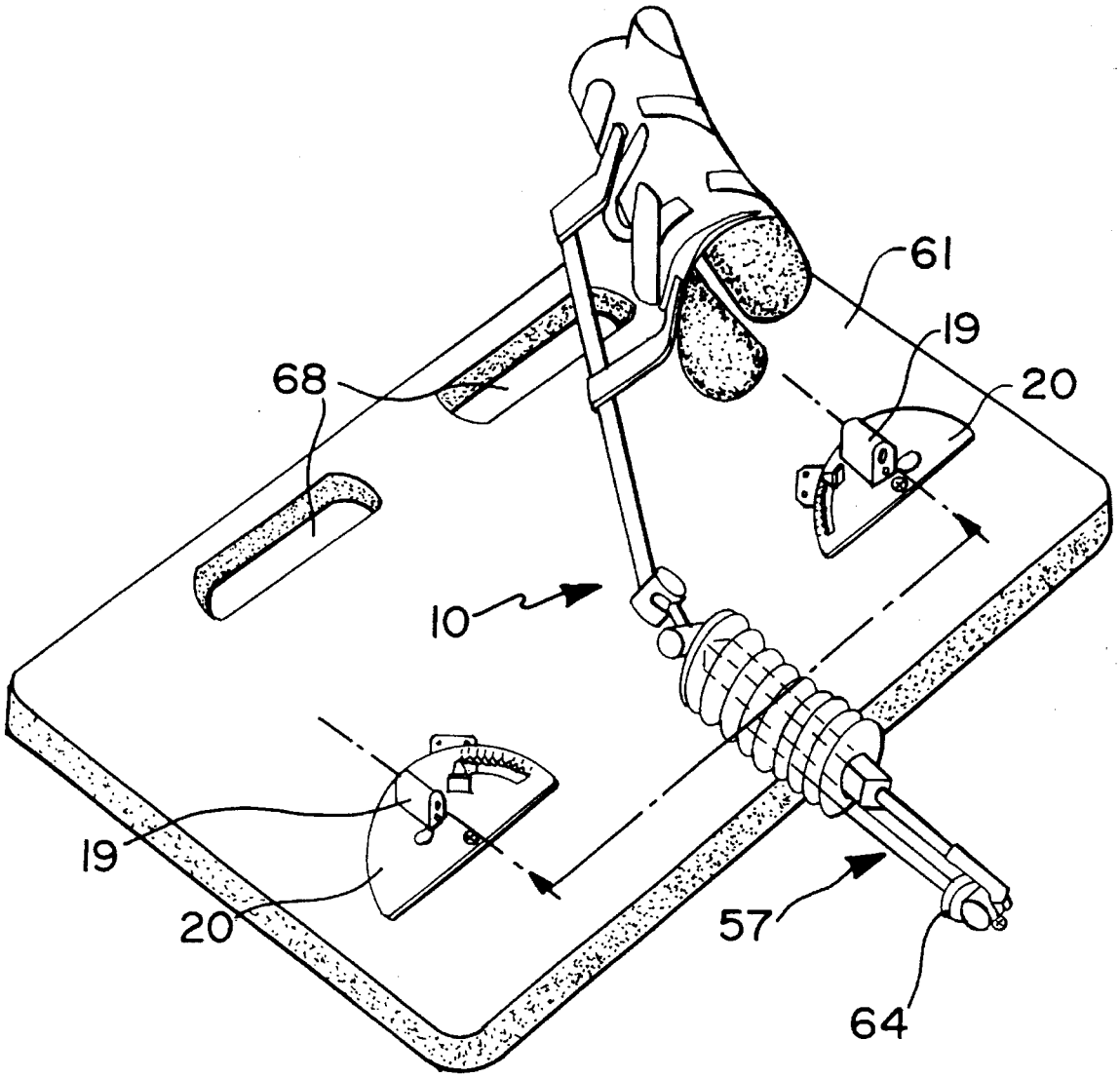
FIG. 15 is a view of the base with two protractor devices.
Figure 16:
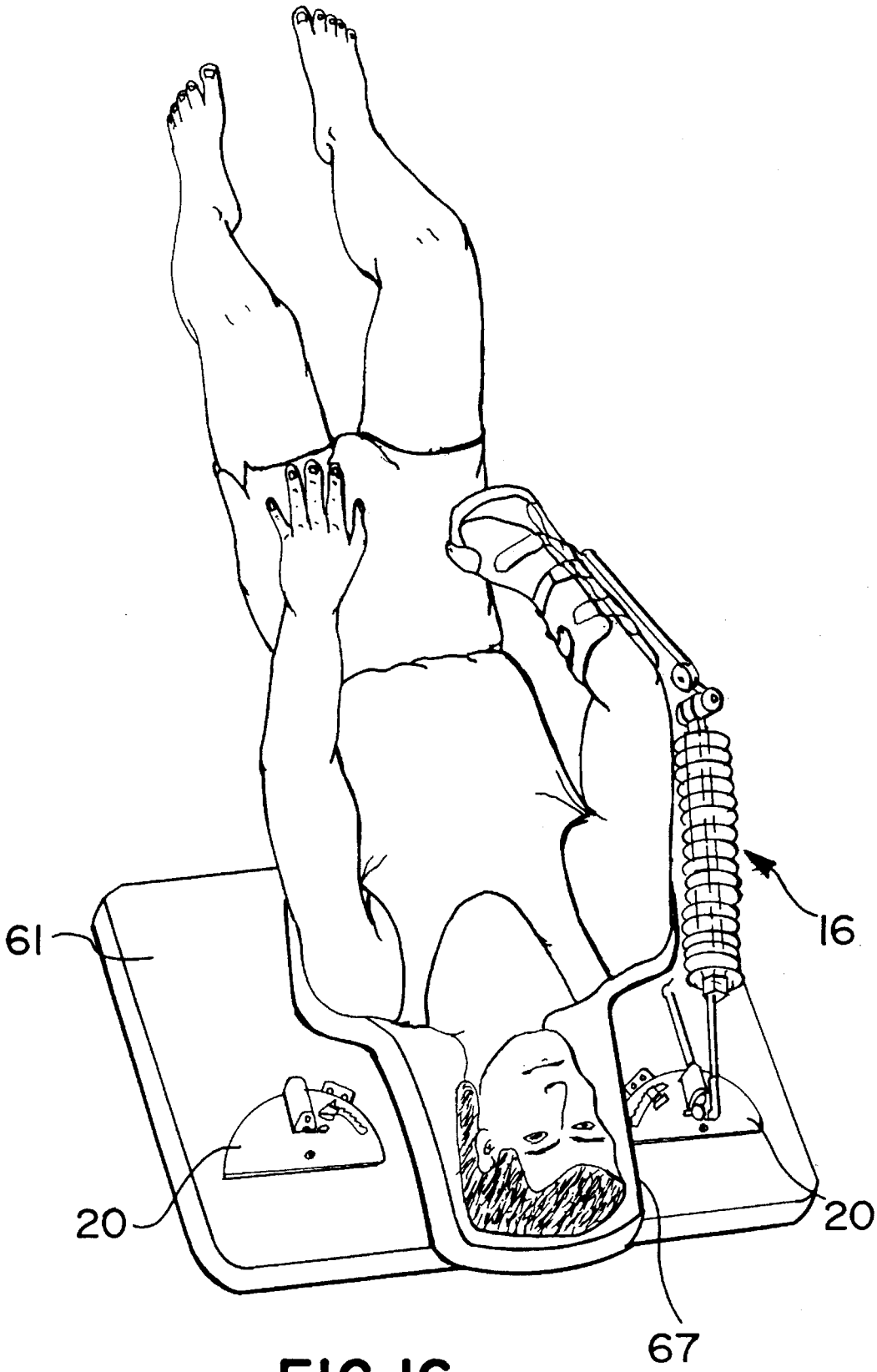
FIG. 16 and 17 are views illustrating the use of the device on the right shoulder and left shoulder.
Figure 17:
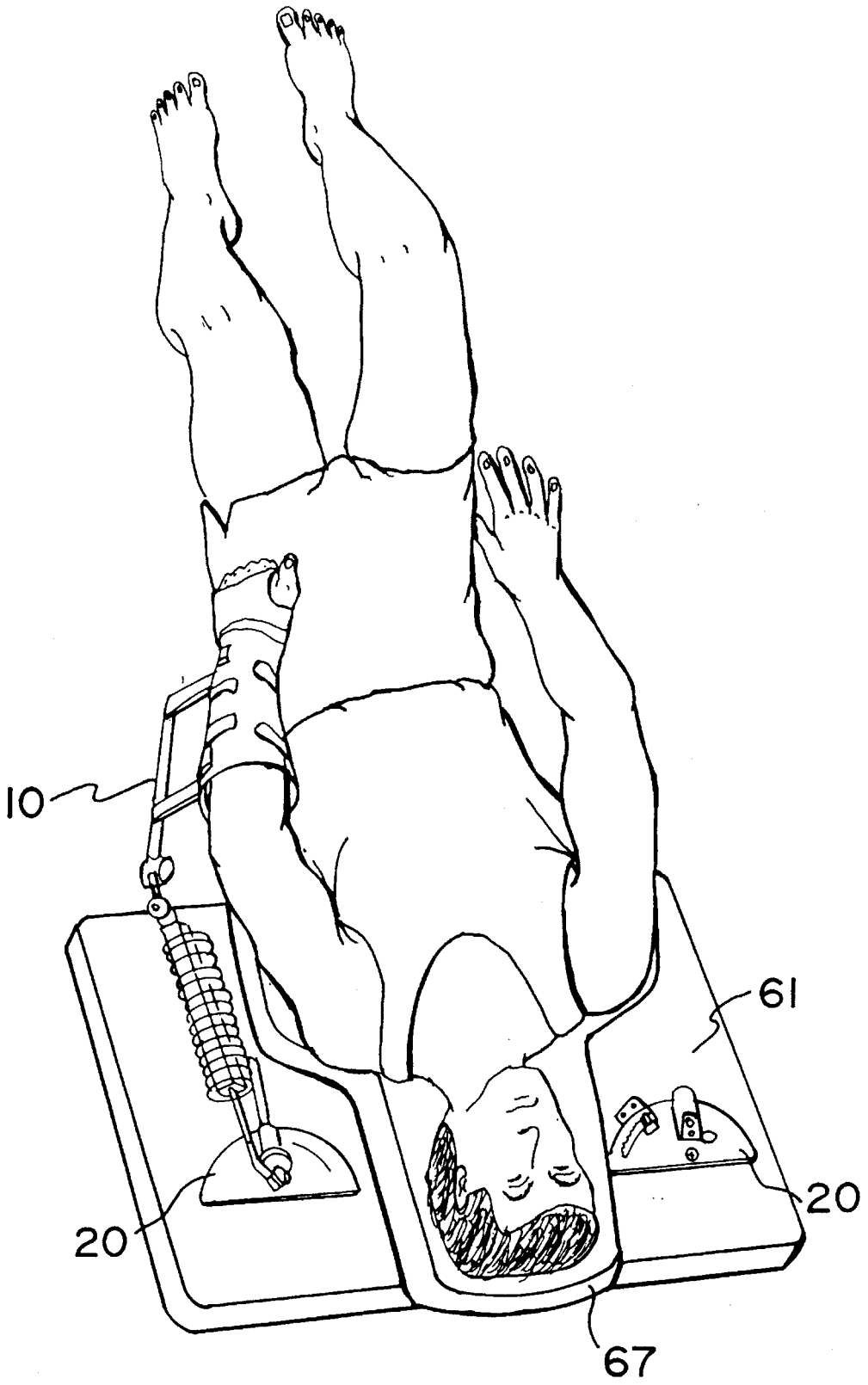

The protractor 20 and the pivotally hinged mechanism 18 are attached to a flat base 61. The flat base 61 can be made of wood or plastic or a like material which could support the attached members of the physical therapy device. As a unique feature (FIG. 15), there are attached to the base two protractors 20, one for the left shoulder and the other for the right shoulder. Each protractor 20 has attached thereto a physical therapy device retainer 19. This allows a single articulated physical therapy device 10 to be used on each side of the base. One side for the left shoulder and the other side for the right shoulder. Attached on top of the base is a head and shoulder support pad 67 (FIGS. 16 and 17) for comfort of the user. For convenience of moving the physical therapy device from place to place, there is supplied cut-out carrying handles 68.

In operating the Dynasplint shoulder device the therapist gently secures the patient to the shoulder device through the wrist stabilizer for consistent day-to-day usage. The therapist then makes a tension adjustment for shoulder external rotation at the elbow tensioning device. The abduction protractor is then set by merely setting the degree of abduction to the desired angle. The elevation component or the shoulder pivot tension is then set. This is a most important feature of the shoulder therapy device because of its ability to accommodate to the multi-axial, multi-planar biomechanics of the complex shoulder joint. This movement is achieved by the synchronized actions of the elevation, external rotation and telescoping components of the upper extremity linkage design.

SHOULDER LPS SYSTEM PROTOCOL

The Shoulder System is designed to treat adhesive capsulitis/frozen shoulder. The System uses the principles of dynamic stressing, also referred to as low-load, prolonged-duration stretching. The goal is for a near complete resolution of the frozen shoulder., in the shortest period of time.

Depending on many factors, including patient history, diagnosis, compliance levels, degree and severity of condition being treated, the total time required from onset of treatment to completion of the program, using the Dynasplint System can range from three weeks to three months.

The following protocol is recommended:

1. Carefully assess the patient's active and passive shoulder range of motion in all planes including flexion, external rotation, abduction, horizontal abduction and internal rotation. The patient needs a minimum of 70° of flexion, actively or passively, in order to begin treatment with the frozen shoulder physical therapy device or Shoulder System.
2. After the patient is properly fitted to the System, daily applications in-clinic can begin. Initially, 10 to 15-minute application periods (1 to 3 times per day) should be made. The elevation spring tension component is set to 3.0 and the external rotation spring tension component is set to 1.0.
3. Graduate the application periods up to 15 to 30-minute sessions (2 to 3 times per day) while keeping the tension settings unchanged. After one to two weeks of in-clinic use, the patient may begin daily applications at home as well. It also may be beneficial to use moist heat application during Dynasplint frozen shoulder physical therapy sessions. This can be achieved using hot packs or hot, moist towels. While in-clinic, other treatment interventions such as gentle joint mobilization, gentle passive range-of-motion exercises, ultrasound, electrical stimulation, etc., may be instituted.
4. After maximum application time is achieved, graduate the tension as tolerated by the patient in increments of 0.5 in both the elevation and external rotation components. Remember, just as with all other Dynasplint LPS™ Systems, never sacrifice time of application for higher levels of tension.

There are many benefits to be derived from using the frozen shoulder physical therapy device of this invention.

The device is unique in that it allows for the dynamic stressing of the shoulder. Greater benefit will be derived from this device as opposed to the passive motion devices in that the device provides added use of musculature, thereby bringing about a more speedy recovery. The device is envisioned as being a device primarily employed for treating frozen shoulder (Adhesive Capsulitis), however the device could be used to strengthen the musculature of the arm and shoulder as needed.

Obviously, many modifications may be made without departing from the basic spirit of the present invention. Accordingly, it will be appreciated by those skilled in the art that within the scope of the appended claims, the invention may be practiced other than has been specifically described herein.

What is claimed is:

1. An articulated shoulder physical therapy device for improving the range of motion of a shoulder comprising an articulated device which allows for the active multiaxial exercise of a shoulder, the articulated device being provided with a forearm strut and an upper arm strut, as well as one or more tensioning means to place stress on the shoulder during active multiaxial exercise, the forearm strut being attached by a hinge to a first end of said upper arm strut to form an elbow hinge and the second end of the upper arm strut being provided with a shoulder hinge and means for accommodating the multiaxial rotation of the shoulder with the articulated shoulder physical therapy device being able to improve the mobility of the shoulder and hasten the return of the shoulder to normal mobility in the directions of flexion, extension, abduction, adduction, horizontal abduction, horizontal adduction, external rotation and internal rotation.

2. The articulated shoulder physical therapy device of claim 1 wherein the tensioning means to place stress on the shoulder is positioned at an elbow hinge between the forearm strut and upper arm strut.

3. The articulated shoulder physical therapy device of claim 1 wherein the tensioning means to place stress on the shoulder is positioned at the shoulder hinge of the upper arm strut.

4. An articulated shoulder physical therapy device of claim 1 wherein there is a tensioning means at the shoulder hinge and a second tensioning means at the elbow hinge.

5. The articulated shoulder physical therapy device of claim 1 wherein the tensioning means is provided with a mechanism for quantifiably adjusting the amount of tension.

6. The articulated shoulder physical therapy device of claim 1 wherein the upper arm strut is a reciprocating telescoping strut allowing for lengthening or shortening of the telescoping strut during active multiaxial exercise of the shoulder.

7. The articulated shoulder physical therapy device of claim 1 wherein the forearm strut is provided with a means to adjust the length of the forearm strut.

8. The articulated shoulder physical therapy device of claim 1 wherein the forearm strut has attached thereto a means for securing the arm to the forearm strut.

9. The articulated shoulder physical therapy device of claim 1 wherein there is provided a base having mounted thereon a protractor and fixedly attached to the protractor a securing means for attaching said articulated shoulder physical therapy device.

10. An articulated shoulder physical therapy device for releasing a shoulder comprising an articulated device which allows for multiaxial exercise of the shoulder in the directions of flexion, extension, abduction, adduction, horizontal abduction, horizontal adduction, external rotation and internal rotation, the device comprising an adjustable forearm strut, a reciprocating telescoping upper arm strut, an adjustable protractor with retaining means attached thereon, and a base, said adjustable forearm strut having a first end and a second end and an adjustment means therebetween which can be adjusted to accommodate the length of the arm of the user, said first end of said forearm strut having attached thereto a means for retaining the forearm, said reciprocating telescoping upper arm strut having a first end and a second end, said first end of said reciprocating telescoping upper arm strut being tensionally hinged through a hinge provided with a tensioning device to said second end of said adjustable forearm strut, said second end of the reciprocating telescoping upper arm strut being pivotally tensionally attached through a hinge provided with tensioning device to said adjustable protractor through said retaining means attached thereon, said adjustable protractor being mounted on said base, such that when a patient is fitted into the physical therapy device with the tensioning means set, the patient can engage in multi-axial physical therapy for the shoulder.

11. The articulated shoulder physical therapy device of claim 10 wherein an adjustable spring produces the tension in each tensioning device.

12. The articulated shoulder physical therapy device of claim 10 wherein each hinge is provided with a tension device which has tension supplied by a mechanism for quantifiably adjusting the amount of tension.

13. The articulated shoulder physical therapy device of claim 11 wherein the forearm strut is provided with a means to adjust the length of the forearm strut.

14. The articulated shoulder physical therapy device of claim 10 wherein the forearm strut has attached thereto a means for securing the arm to the forearm strut.

15. The articulated shoulder physical therapy device of claim 10 wherein the base has a left side and a right side and wherein both the left side and the right side of said base are provided with a protractor and fixedly attached to each protractor a securing means for attaching an articulated shoulder physical therapy device such that a single unit of the articulated shoulder physical therapy device can be used to treat either the left shoulder or the right shoulder.

16. An articulated shoulder physical therapy device for releasing a shoulder comprising an articulated device which allows for multiaxial exercise of the frozen shoulder in the directions of flexion, extension, abduction, adduction, horizontal abduction, horizontal adduction, external rotation and internal rotation, the device comprising an adjustable forearm strut, with means to retain the arm, a reciprocating telescoping upper arm strut, an adjustable protractor with attached retaining means, and a base, said adjustable forearm strut having a first end and a second end and an adjustment means therebetween which can be adjusted to accommodate the length of the arm of the user, said first end of said forearm strut having attached thereto a means for retaining the forearm, said reciprocating telescoping upper arm strut having a first end and a second end, said first end of said telescoping upper arm strut being quantifiably spring tensionally hinged through a hinge provided with tensioning device to said second end of said adjustable forearm strut, said second end of the telescoping upper arm strut being pivotally and quantifiably spring tensionally attached through a hinge provided with a tensioning device to said adjustable protractor through retaining means attached thereon, said adjustable protractor being mounted on said base, such that when a patient is fitted into the device with the tensioning means set, the patient can engage in multiaxial physical therapy for a frozen shoulder.

17. The articulated shoulder physical therapy device of claim 16 wherein the base has a left side and a right side and wherein both the left side and the right side of said base are provided with a protractor and fixedly attached to each protractor a securing means for attaching said articulated shoulder physical therapy device such that a single unit of the articulated frozen shoulder physical therapy device can be used to treat either the left shoulder or the right shoulder.

18. A physical therapy device for treating the "frozen shoulder" of a patient, comprising a substantially planar base, such that the patient may lie down with his or her shoulders supported on the base, an upper arm strut having a pair of ends, one end of which is pivotally mounted on the base for movement towards and away from the base about an axis substantially parallel to the base, means for adjusting the length of the upper arm strut to accommodate the patient, first tensioning means associated with the upper arm strut and resisting the pivotable movement of the upper arm strut away from the base, a forearm strut pivotally connected to the other end of the upper arm strut and cantilevered thereon, second tensioning means associated with the upper arm strut to accommodate the patient, and a cuff carried by the lower arm strut, laterally thereof, for receiving the forearm of the patient.

19. The physical therapy device of claim 18, wherein means are further provided for adjustably mounting the upper arm strut on the base about an axis substantially perpendicular to the base.

20. The physical therapy device of claim 19, wherein said means provided for adjustably mounting the upper arm strut on the base includes a first protractor assembly secured to the base.

21. The physical therapy device of claim 20, further including a second protractor secured to the base, such that the physical therapy device may be removed from the first protractor and secured to the second protractor, thereby facilitating use of the device in treating the right or left shoulder of the patient.

* * * * *